US009555952B2

(12) United States Patent
Dawson et al.

(10) Patent No.: US 9,555,952 B2
(45) Date of Patent: Jan. 31, 2017

(54) CONTAINER WITH CHILD-RESISTANT LATCHING MECHANISM

(71) Applicants: Fred Dawson, Lake Orion, MI (US); Michael A. Klein, Huntington Woods, MI (US)

(72) Inventors: Fred Dawson, Lake Orion, MI (US); Michael A. Klein, Huntington Woods, MI (US)

( * ) Notice: Subject to any disclaimer, the term of this patent is extended or adjusted under 35 U.S.C. 154(b) by 822 days.

(21) Appl. No.: 13/941,916

(22) Filed: Jul. 15, 2013

(65) Prior Publication Data

US 2014/0014538 A1 Jan. 16, 2014

Related U.S. Application Data

(60) Provisional application No. 61/671,203, filed on Jul. 13, 2012.

(51) Int. Cl.
*B65D 83/04* (2006.01)
*A61J 1/00* (2006.01)
*A61J 1/16* (2006.01)

(52) U.S. Cl.
CPC ..... *B65D 83/0409* (2013.01); *A61J 1/00* (2013.01); *A61J 1/16* (2013.01); *B65D 83/0445* (2013.01); *B65D 2215/02* (2013.01)

(58) Field of Classification Search
CPC ..... A61J 1/00; A61J 1/03; A61J 7/0069; A61J 7/04; A61J 7/0409; A61J 7/0418; A61J 7/0427; A61J 7/0436; A61J 7/0445; A61J 7/0454; A61J 2200/70; A61J 2205/10; A61J 2205/20; A61J 2205/30; G07F 7/10; G07F 11/62; G07F 17/0092; B65D 83/0409; B65D 83/0445; B65D 83/0454; B65D 2215/02
USPC ... 221/7–9, 91, 231, 256; 206/1.5, 216, 528, 206/534, 538, 564, 570; 222/47, 485, 511; 292/150, 175
See application file for complete search history.

(56) References Cited

U.S. PATENT DOCUMENTS

| | | | | |
|---|---|---|---|---|
| 3,871,551 | A | 3/1975 | Bender | |
| 4,319,700 | A | 3/1982 | Celender et al. | |
| 4,735,558 | A | 4/1988 | Kienholz et al. | |
| 4,763,810 | A * | 8/1988 | Christiansen | A61J 7/0481 221/15 |
| 5,377,864 | A * | 1/1995 | Blechl | A61J 7/0084 221/102 |
| 5,887,736 | A | 3/1999 | Mar | |
| 6,095,364 | A | 8/2000 | Dickie et al. | |
| 6,415,202 | B1 * | 7/2002 | Halfacre | A61J 7/0481 221/102 |

(Continued)

*Primary Examiner* — J. Gregory Pickett
*Assistant Examiner* — Brijesh V. Patel
(74) *Attorney, Agent, or Firm* — Avery N. Goldstein; Blue Filament Law PLLC

(57) ABSTRACT

A container and dispensing system is provided that includes a tamper resistant and sealable container with a child resistant latching mechanism. The container includes at least one hopper for storing a controlled substance or sensitive material, and includes a container unit locking lid with a locking mechanism that may be opened through manual manipulation or through the use of a key. In at least one embodiment, the locking mechanism is a flat spring locking device. A designated person, in the event of a pill container, a pharmacist, may control an optionally required key for removing the lid during refill operations. For other sensitive materials where tampering or unauthorized access is desired, such as a feed hopper, the owner of the container may retain control of the optional key.

18 Claims, 6 Drawing Sheets

(56) References Cited

U.S. PATENT DOCUMENTS

| | | | | |
|---|---|---|---|---|
| 6,966,238 | B2 | 11/2005 | Panek et al. | |
| 7,380,995 | B2 | 6/2008 | Chan | |
| 7,494,012 | B1 * | 2/2009 | Priebe | A61J 1/03 206/1.5 |
| 7,658,286 | B2 * | 2/2010 | Murray | B65B 43/04 206/459.1 |
| 8,090,472 | B2 * | 1/2012 | Schifman | G07F 11/44 700/231 |
| 2005/0031228 | A1 * | 2/2005 | Galomb | B65D 33/34 383/96 |
| 2005/0238765 | A1 * | 10/2005 | Weaver | B32B 27/32 426/106 |
| 2006/0184271 | A1 * | 8/2006 | Loveless | A61J 7/0084 700/231 |
| 2006/0265102 | A1 * | 11/2006 | Bain | G06F 19/3462 700/237 |
| 2007/0007162 | A1 * | 1/2007 | Buller | A61J 7/0069 206/534 |
| 2007/0029343 | A1 * | 2/2007 | Sanfilippo | A47G 19/183 222/102 |
| 2011/0052100 | A1 * | 3/2011 | Eisenberg | B65D 33/165 383/12 |
| 2013/0319902 | A1 * | 12/2013 | Tufi | A61J 1/035 206/534 |

* cited by examiner

CONTAINER WITH CHILD-RESISTANT LATCHING MECHANISM

CROSS-REFERENCE TO RELATED APPLICATIONS

This application claims priority benefit of U.S. Provisional Application Ser. No. 61/671,203, filed Jul. 13, 2012; the contents of which are hereby incorporated by reference.

FIELD OF THE INVENTION

The present invention in general relates to latching mechanisms for containers used for carrying and dispensing, and in particular to those of the kind for dispensing feed, prescription medication, over the counter medication or any other controlled substance or sensitive material where a restraint from child access is desired.

BACKGROUND OF THE INVENTION

For several years, there has been increased concern for protecting children's access to controlled substances, sensitive material, and inadvertent access to sensitive materials. However, the art has generally failed at creating such a device. Particularly with pill containers, most often young children have the necessary dexterity and skill to open the containers, while ironically the elderly have an arduous task in opening a pill container on their own. It is not uncommon for an elderly person to instruct a young child, who lacks the cognitive ability to know the dangers of ingesting the pills themselves, to open a pill container for them.

It should be appreciated that with controlled substances, such as prescription medications, ingestion of only one or two pills of certain prescribed medications may prove fatal to a child. Thus increased restriction to prescription medication storage devices, such as pill boxes, is desired while improving the ability for the elderly to gain access on their own. Moreover, there is an increasing awareness of the necessity to provide containers for prescribed medications which may otherwise be readily and easily opened by an adult which requires certain manipulation and manual dexterity. When an adult, such as the elderly, who suffers from a debilitating condition, such as arthritis, has the expectation of visits by active and curious grandchildren, they may instruct their pharmacist to dispense their prescribed medications in pill containers that require specific manipulation and manual dexterity with lesser physical effort, but which are still child-resistant.

There are several well-known, so-called, child-proof or child-resistant pill containers in the market, and which are generally employed by dispensing pharmacists for use in filling prescriptions, where the prescription requires that the pharmacist dispense one or more of a plurality of pills, tablets, gel-caps, capsules, or the like. The child-proof or child-resistant pill containers include the so-called "push-and-turn" closures for pill containers, or "arrow-alignment" closures for pill containers. In both cases, the pill containers are of the standard cylindrical variety and fail to meet the concerns realized by the public at large.

One method used today employs a panel inset into a recess formed in a cylindrical container cap, and is slidable into and out of that cap. The device is said to be child safe because it requires the physical pressure to engage a clutch mechanism to the inset panel, thus engaging the cap to open. It is these such containers which most are accustomed and are readily operable by children as young as three (3) years of age, while being inoperable by the elderly or those suffering from arthritis.

Other mechanisms, such as those found in U.S. Pat. No. 5,887,736, may require two simultaneous movements so as to open a container. While it is claimed that the operability of this device exceeds the capabilities of most young children, it also exceeds the dexterity that may be afforded by many adult patients, not including the elderly and those suffering from arthritis.

Additionally, there is an increasing awareness by persons who are in possession of controlled substances, such as prescription medications, to be assured in their own minds that a storage container has not been tampered in the interval between uses. In parallel with the growing concerns for the youth, other concerns include tampering and potentially poisoning feed dispensers or inadvertent access to the feed by animals biting or mechanically agitating a feed storage device.

Thus there remains an unmet need for providing a container which includes a latching device or mechanism to adequately meet the concerns outlined above.

SUMMARY OF THE INVENTION

The present invention provides for a child resistant latching mechanism which may be used on any container in which access is to be minimized to young persons, while also limiting the tampering and inadvertent operation through mechanical agitation.

One embodiment of the inventive system includes a tamper resistant and sealable container which includes a child resistant latching mechanism. The container includes at least one hopper for storing a controlled substance or sensitive material, and includes a container unit locking lid with a locking mechanism that may only be opened through the use of a key. In at least one embodiment, the locking mechanism is a flat spring locking device. It should be appreciated that a designated person, in the event of a pill container, the pharmacist, shall control the key for removing the lid during refill operations. For other sensitive materials where tampering or unauthorized access is desired, such as a feed hopper, the owner of the container may want to retain control of the key.

Embodiments of the inventive container further include a second lid, or a receiving tray lid, for accessing the contents of the container, the second lid including a child-resistant device. The child resistant device includes two spring releasable sliders which are rigidly attached to a latching mechanism which hold the lid shut from an interior latching point. To release the second lid, the sliders are simultaneously depressed and slid along the track to a position inward of the length of the second lid, thereby unlatching the second lid for access to the contents of the controlled substance or sensitive material inside the container. Preferably the second lid is hingedly attached to the container, but may be fully removable depending on the controlled substance and ultimate use of the container.

In another embodiment of the inventive container system, the child restraints of the tray lid may be connected to an electro-mechanical device which may be operated remotely from a remote device, such as a necklace containing an RF transmitter, or with the use of a keyed entry pass code or a passive transmitter key fob.

In another inventive embodiment, the container may be fastened to the underside of a cabinet after filling, thus further restricting the ability to gain access or tamper with the contents through the container unit locking lid.

Other embodiments of the inventive container system may include an adjustable aperture opening of the hopper which may limit the amount of the controlled substance being accessed in a single use. For instance, where the container is fashioned and used for the storage of prescribed medications in pill form, the adjustable aperture can be manipulated such that a desired dose is dispensed into the receiving tray of the container, for which access is gained through the second, child-resistant, lid.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which like reference designators are utilized to identify like elements, and in which:

DESCRIPTION OF THE PREFERRED EMBODIMENTS

Figure 1A:
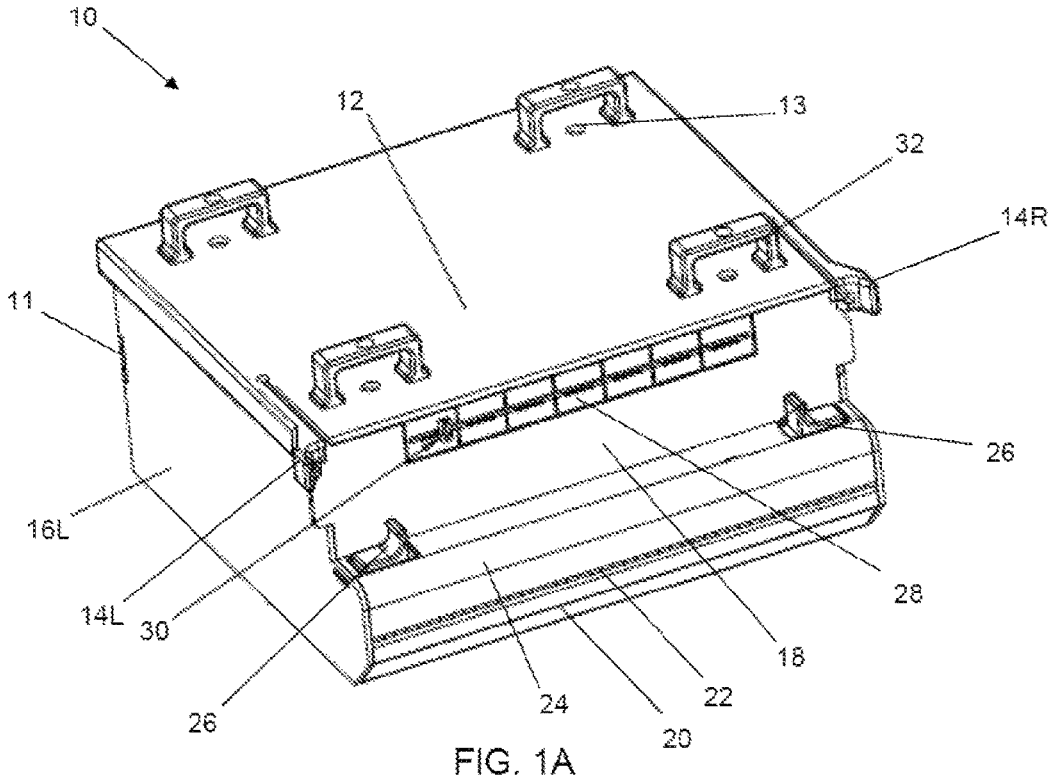
FIGS. 1A and 1B are top and front perspective views, respectively, of a storage and dispensing container with child resistant locking mechanisms according to an embodiment of the invention.

The following description refers to embodiments of a storage container and child resistant locking mechanism intended to restrict access to certain materials or substances in which one may want to limit access, especially to children. A specific, non-limiting, embodiment of the dispensing container is for the purpose of storing and limiting access to prescription medications, however such disclosure is not intended to limit the use of the container and locking mechanism to only the pharmaceutical industry as it relates to child-proof devices. Restricting access to certain materials and substances is desired for several reasons across several industries, including but not limited to, alcoholic beverages (such as coolers), tool boxes, feed bins, and paints or other harmful chemicals.

As used herein, "controlled substance" may refer to any drug or chemical whose manufacture, possession, or use is regulated by a government. This may include illegal drugs, prescription medications, alcoholic beverages, weapons and ammunition, explosives or pyrotechnics, etc.

As used herein, "sensitive materials" may refer to any material or substance where restricted access is desired. This may restricted access to include livestock feed to prevent tampering or poisoning, certain documents not meant for general access, tools whether power tools or conventional tools or other items, materials or substances which may prove to be an attractive nuisance to a young child and have the potential for serious harm As used herein, "lid" or "container lid" shall mean any device used to secure, close and generally prevent inadvertent access to any opening to the container.

As used herein, "tamper resistant" shall refer to any means which provides a resistance to tampering by either the normal users or those who may have physical access to a container holding a controlled substance or sensitive material.

As used herein, "child resistant latching mechanism" shall refer to any means which provides a resistance to access to those individuals lacking the dexterity and cognitive ability to gain access to a container holding a controlled substance or sensitive material through normal operation of a container lid.

As used herein, "hopper" shall mean a large container for storage. For example a hopper may be internal to a container where the use of one or many hoppers allows segregating several different types of controlled substances or sensitive materials.

As used herein, "locking mechanism" shall refer to a mechanical or electronic fastening device that is released by a key which may be a physical object or an electronic code.

As used herein, "receiving tray" shall mean an access point to an end user for receiving a controlled substance or sensitive information for which restricted access or resistance to tampering may be desired.

Embodiments of the present invention provide for a child resistant latching mechanism which may be used on any container in which access is to be minimized to young persons, while also limiting the tampering and inadvertent operation through mechanical agitation.

Embodiments of the inventive container and dispensing system include a tamper resistant and sealable container that includes a child resistant latching mechanism. The container includes at least one hopper for storing a controlled substance or sensitive material, and includes a container unit locking lid with a locking mechanism that may be opened through manual manipulation or through the use of a key. In at least one embodiment, the locking mechanism is a flat spring locking device. It should be appreciated that a designated person, in the event of a pill container, the pharmacist, may control an optionally required key for removing the lid during refill operations. For other sensitive materials where tampering or unauthorized access is desired, such as a feed hopper, the owner of the container may want to retain control of the optional key.

Embodiments of the inventive container further include a second lid, or a dispensing tray lid, for accessing the contents of the container, the second lid including a child-resistant device. The child resistant device includes two spring releasable sliders or release levers which are rigidly attached to a latching mechanism which hold the lid shut from an interior latching point. To release the dispensing tray lid, the slider release levers are simultaneously depressed and slid along to a position inward of the length of the dispensing tray lid, thereby unlatching the tray lid for access to the contents of the controlled substance or sensitive material inside the container. Preferably the tray lid is hingedly attached to the container, but may be fully removable depending on the controlled substance and ultimate use of the container.

In a specific embodiment of the inventive container system, the child restraints of the tray lid may be connected to an electro-mechanical device which may be operated remotely from a remote device, such as a necklace containing an RF transmitter, or with the use of a keyed entry pass code or a passive transmitter key fob. Embodiments of the inventive container may be fastened to the underside of a cabinet after filling, thus further restricting the ability to gain access or tamper with the contents through the container unit locking lid.

Figure 1B:
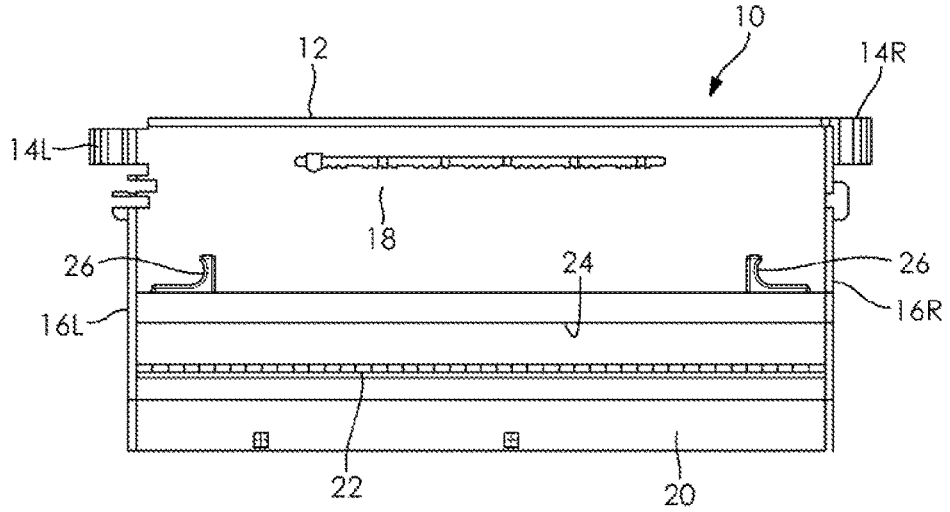

Referring now to the figures, FIGS. 1A and 1B are top and front perspective views, respectively, of a storage and container 10 with child resistant locking mechanisms according to an embodiment of the invention. The container 10 has a cover 12 with manual securements 14R and 14L on the right and left sides, respectively, of cover 12 to disengage from the base portion 11. In an embodiment a keyed locking mechanism (not shown) locks the cover 12 to the base 11, for further restricted access. The base portion 11 has side walls 16R and 16L that are fixedly attached to a back wall 38 (see FIG. 5), a front face 18, and a lower lip 20. The lower lip 20 has a hinged or flexible attachment 22 to a tray lid 24 that covers the dispensing area of the container 10. The tray lid 24 has slider release levers 26, shown as right slider release lever, 26R and a left slider release lever, 26L that secure the tray lid to the side walls 16R and 16L, respectively, in a closed position when the tray lid 24 is positioned upward over the lower lip 20. A seven day indicator or schedule 28 with adjustable marker tab 30 may be provided on the front face 18 for tracking usage of medication or other dispensed items. In certain embodiments (not shown) an electronic interface, such as a light emitting diode (LED) or liquid crystal display (LCD) may be used for tracking dispensed items. The cover 12 has mounting holes 13 for securing the container 10 to the underside of a cabinet or shelf, so as to clutter on a counter top or table and to remove the container from the immediate reach of a child. Spacer brackets 32 may optionally be attached to the cover 12 to adjust the placement height of the container 10, as well as to compensate for non-standard cabinet installations.

Figure 2:
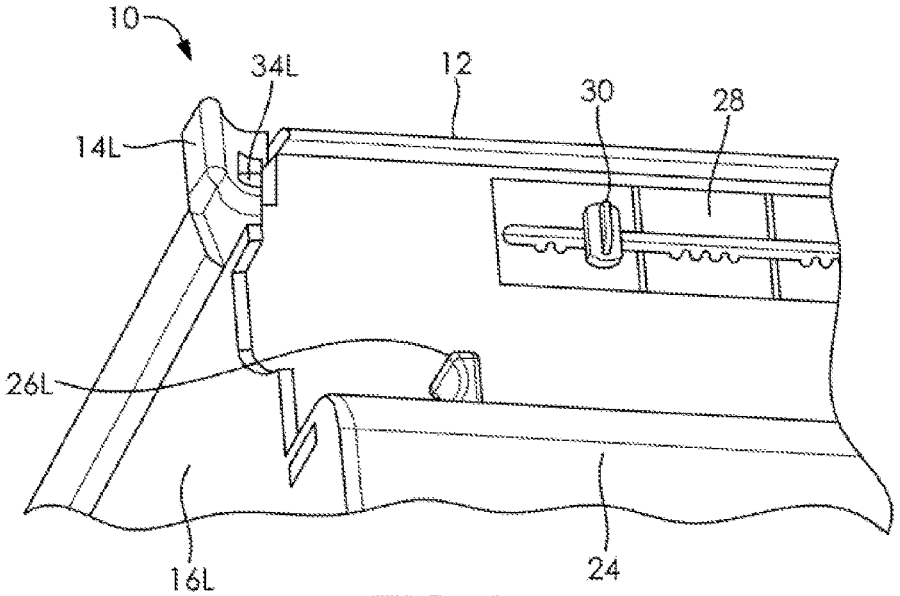
FIG. 2 is a close up perspective view of the container of FIGS. 1A and 1B showing one of the cover release securements and one of the dispensing tray cover release lever.
Figure 3:
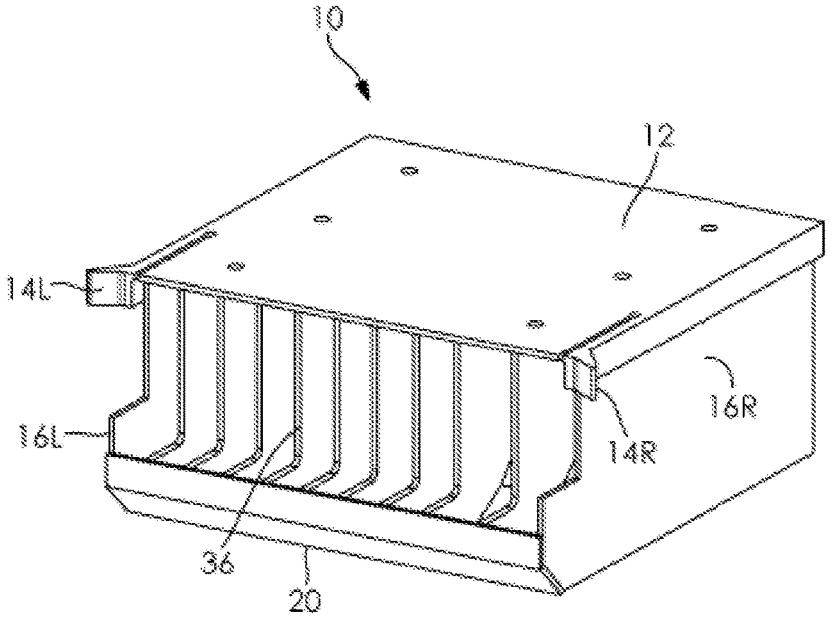
FIG. 3 is a front top perspective view of the container of FIGS. 1A and 1B with the front panel and dispensing tray cover removed to show the internal storage hopper according to an embodiment of the invention.
Figure 4:
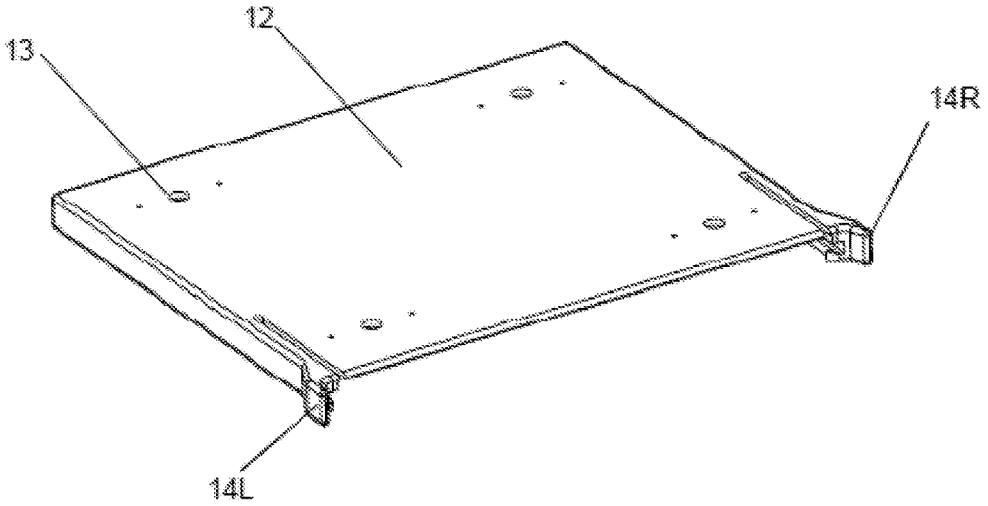
FIG. 4 is a top perspective of the removable container cover with cover release securements according to an embodiment of the invention.
Figure 5:
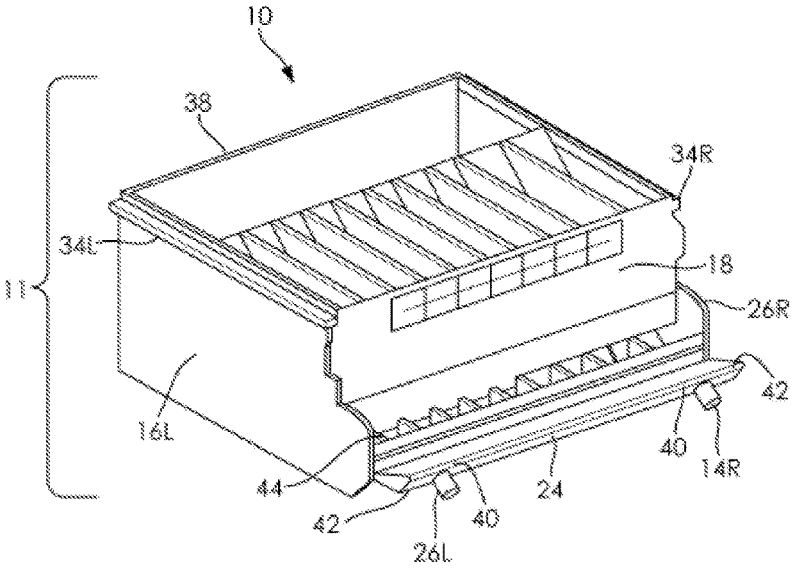
FIG. 5 is a front top perspective view of the container of FIGS. 1A and 1B with the container cover removed and dispensing tray cover in an open position to show the internal storage hopper according to an embodiment of the invention.
Figure 6:
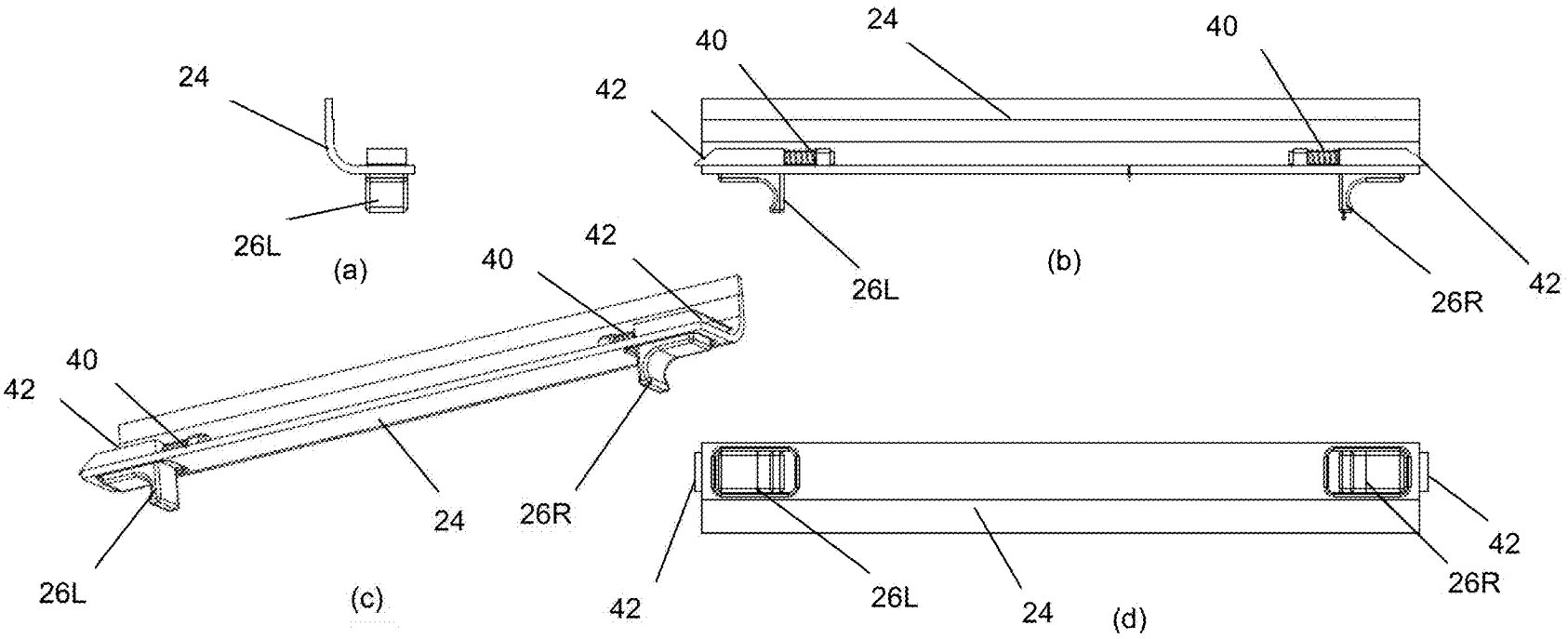
FIG. 6 (*a-d*) are perspective views of the dispensing tray cover with release levers and latches according to an embodiment of the invention.

FIG. 2 is a close up perspective view of the container 10 showing one of the cover release securements 14L and one of the dispensing tray cover release levers 26L. As shown in FIG. 2 and FIG. 5, the cover rides on side rails 34R and 34L, and is secured to the rails with manual securements 14R and 14L, respectively. FIG. 3 is a front top perspective view of the container 10 with the front panel 18 and dispensing tray lid 24 removed to show the internal storage hopper 36. FIG. 4 is a top perspective of the removable container cover 12 with cover release securements 14R and 14L. The manual securements 14R and 14L require simultaneous opposing outward force to release the cover 12 from the rails 14R and 14L and to slide the base 11 from the cover 12 as shown in FIG. 5. With the cover 12 removed, the hopper 36 is visible in FIG. 5. The dispensing area 44 is also visible with the tray lid 24 in an open position, when the tray lid 24 is released and is positioned down over the lower lip 20.

FIGS. 6*a*-6*d* are a series of detailed views of the tray lid 24 and slider release levers 26R and 26L that secure the tray lid to the side walls 16R and 16L via latches 42. The latches 42 are integrated with the slider release levers 26R and 26L. Bias spring 40 pushes the latches 42 outward to engage the side walls 16R and 16L. The outward bias of the springs 40 is overcome with inward pressure applied to the slider release levers 26R and 26L. In order to open the tray lid 24 to expose the dispensing area 44, simultaneous inward pressure must be applied to the slider release levers 26R and 26L.

Figure 7A:
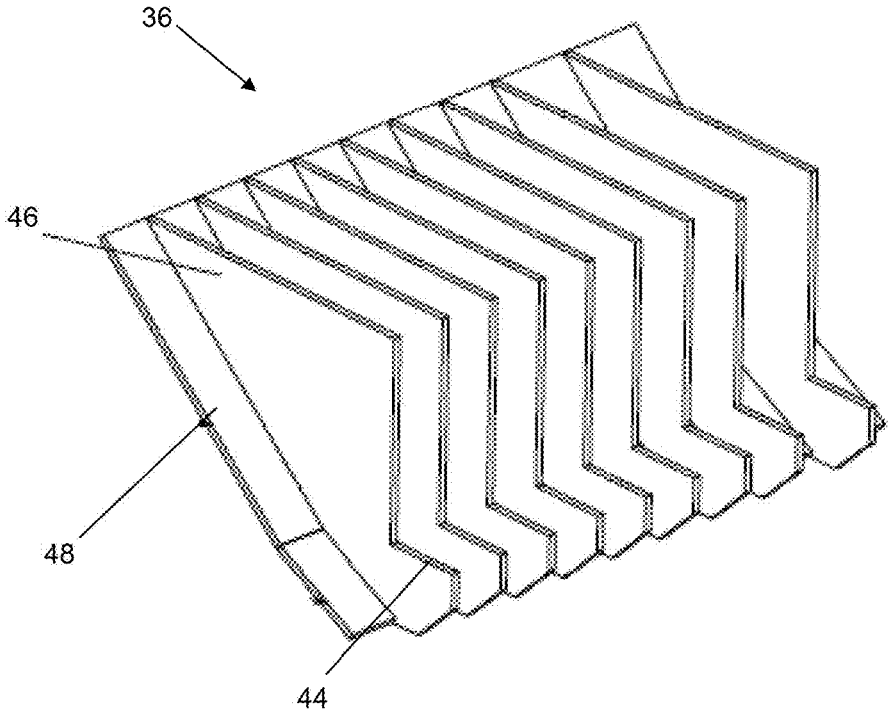
FIGS. 7A and 7B are top and side perspective views, respectively, of the hopper insert according to an embodiment of the invention.
Figure 7B:
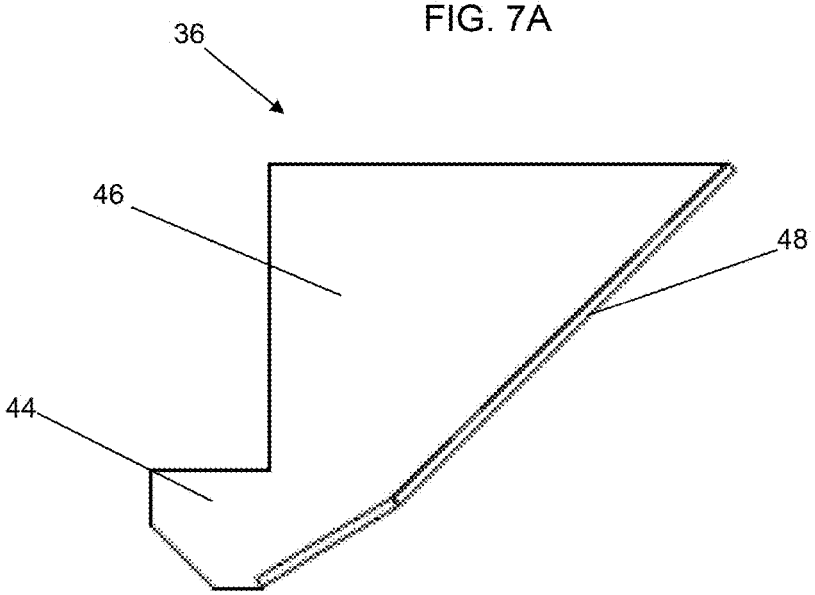

FIGS. 7A and 7B are top and side perspective views, respectively, of the hopper insert 36. The hopper 36 has a series of dividers 46 that create separate compartments for holding different items or daily regiments of medications. The hopper 36 has an inclined floor 48 that funnels content to the dispensing area 44.

Figure 8A:
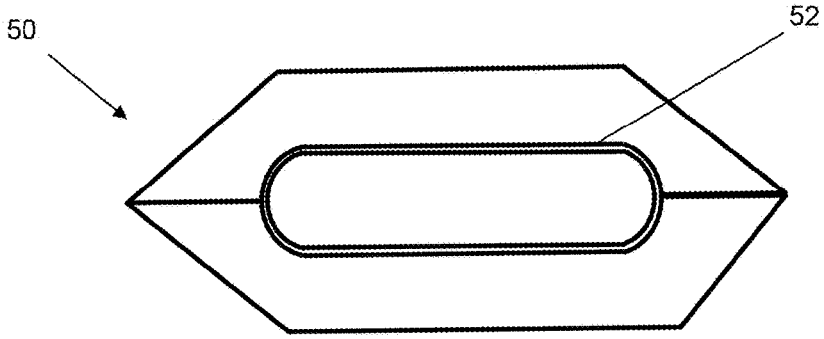
FIGS. 8A and 8B are top and side perspective views, respectively, of a filler bag for use with embodiments of the invention.
Figure 8B:
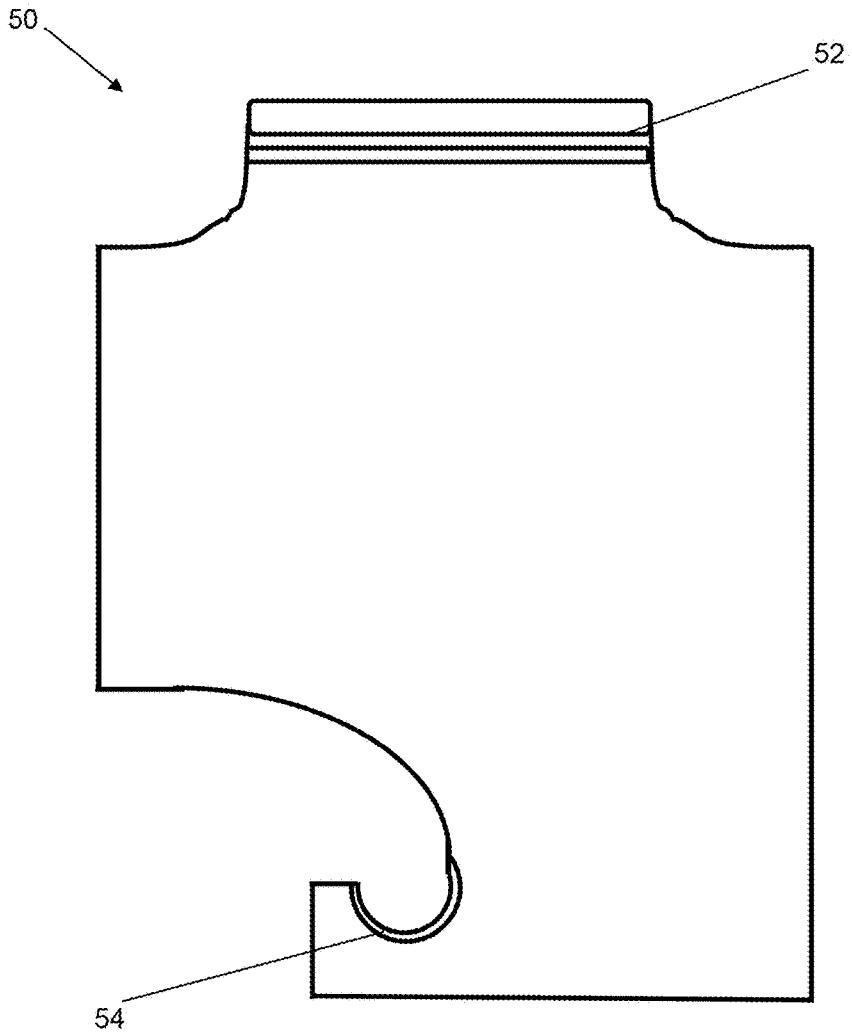

FIGS. 8A and 8B are top and side perspective views, respectively, of a filler bag 50 is a side gusseted pouch for use with embodiments of the inventive container 10. The filler bag may be made of plastic such as, but not limited to, polyethylene terephthalate (PET), linear low-density polyethylene (LLDPE), or foils such as aluminum. The filler bag 50 may be clear or opaque for light sensitive materials. A reinforced loop 54 may be used for hanging unfilled or filled bags. The filler bag 50 may be used at pharmacies to preload medications for use in the container 10. The opening 52 in the bag 50 may be configured for use in the hopper 36, or the contents of the bag may be emptied into the hopper 36.

Example

Where the container is used for storing a controlled substance, such as prescription medications, a pharmacist will fill the at least one hopper with the prescribed medication of a patient. After filling the container, the pharmacist will secure the container locking lid, and pass the filled container to the patient.

Where the patient requires access to the pills stored in the container, the patient will simultaneously depress the buttons on the receiving tray lid and slide the buttons along the slide track until released, then open the receiving tray lid gaining access to the medications. Upon completed use, the patient will close the receiving tray lid, whereby the latching mechanisms will return to their latch position through the use of a spring device. Where a child attempts to gain access to the receiving tray lid, she will lack the required dexterity to simultaneously overcome the spring force to depress the receiving tray push button while sliding the depressed button along the track.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

The invention claimed is:

1. A container for storing a controlled substance or sensitive material, the container comprising:

a base enclosure comprising a pair of opposing side walls mechanically connected by a front face, and a lower lip;

a cover that slides on rails mounted to said opposing side walls;

a dispensing hopper with a dispensing tray area contained within said base enclosure;

a filler bag configured for placement within said dispensing hopper and containing the controlled substance or sensitive material; and a tray lid flexibly attached to said lower lip by opposing slide release levers to control access to said dispensing tray area for said controlled substance or sensitive material.

2. The container of claim 1 wherein said cover further comprises a pair of manual securements that require simultaneous opposing outward force to release said cover from the rails and to slide said base enclosure from the cover.

3. The container of claim 1 wherein said cover is mountable to a cabinet or shelf.

4. The container of claim 1 wherein said tray lid is connected to said lower lip with hinges.

5. The container of claim 1 further comprising an electronic monitor on said front face for tracking usage of medication or other dispensed items.

6. The container of claim 1 wherein said hopper further comprises a series of dividers that create separate compartments for holding said controlled substance or sensitive material, said hopper having an inclined floor that funnels said controlled substance or sensitive material to said dispensing tray area.

7. The container of claim 1 wherein the controlled substance or sensitive material is prescription medication, alcohol, power tools, animal food, or a combination thereof.

8. The container of claim 1 wherein the controlled substance or sensitive material is prescription medications.

9. The container of claim 1 wherein said filler bag is side gusseted.

10. The container of claim 1 wherein said filler bag is made of plastic, polyethylene terephthalate (PET), or linear low-density polyethylene (LLDPE).

11. The container of claim 1 wherein said filler bag is made of metal foils.

12. The container of claim 1 wherein said filler bag has a reinforced loop used for hanging.

13. The container of claim 1 wherein said filler bag has an opening configured for said hopper.

14. The container of claim 1 wherein said filler bag is clear or opaque.

15. A container for storing a controlled substance or sensitive material, the container comprising:

a base enclosure comprising a pair of opposing side walls mechanically connected by a front face, and a lower lip;

a cover that slides on rails mounted to said opposing side walls;

a dispensing hopper with a dispensing tray area contained within said base enclosure; and a tray lid flexibly attached to said lower lip to control access to said dispensing tray area for said controlled substance or sensitive material; and a pair of opposing slide release levers in mechanical communication with latches, said latches engaging said opposing side walls.

16. The container of claim 15 wherein said latches are biased outward by springs to lock said tray lid to said opposing side walls.

17. A container for storing a controlled substance or sensitive material, the container comprising:

a base enclosure comprising a pair of opposing side walls mechanically connected by a front face, and a lower lip;

a cover that slides on rails mounted to said opposing side walls;

a dispensing hopper with a dispensing tray area contained within said base enclosure; and a tray lid flexibly attached to said lower lip to control access to said dispensing tray area for said controlled substance or sensitive material; and a seven day indicator or schedule with an adjustable marker tab.

18. A container for storing a controlled substance or sensitive material, the container comprising:

a base enclosure comprising a pair of opposing side walls mechanically connected by a front face, and a lower lip;

a cover that slides on rails mounted to said opposing side walls;

a dispensing hopper with a dispensing tray area contained within said base enclosure; and a tray lid flexibly attached to said lower lip to control access to said dispensing tray area for said controlled substance or sensitive material; and an electro-mechanical device to allow for automatic operation of the tray lid latches through an RF transmitting device, an electronic passkey or passive RF sensor.

* * * * *